US011178940B2

(12) United States Patent
Hsu et al.

(10) Patent No.: US 11,178,940 B2
(45) Date of Patent: Nov. 23, 2021

(54) SLIDER FOR SLIDE FASTENER

(71) Applicant: YKK Corporation, Tokyo (JP)

(72) Inventors: Hsien Hsiang Hsu, Taipei (TW); Shinya Honda, Taipei (TW)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 17/261,381

(22) PCT Filed: Jul. 31, 2018

(86) PCT No.: PCT/JP2018/028610
§ 371 (c)(1),
(2) Date: Jan. 19, 2021

(87) PCT Pub. No.: WO2020/026334
PCT Pub. Date: Feb. 6, 2020

(65) Prior Publication Data

US 2021/0315328 A1 Oct. 14, 2021

(51) Int. Cl.
*A44B 19/30* (2006.01)
*A44B 19/26* (2006.01)

(52) U.S. Cl.
CPC ..... *A44B 19/308* (2013.01); *A44B 19/262* (2013.01)

(58) Field of Classification Search
CPC .. A44B 19/308; A44B 19/262; Y10T 24/2586
See application file for complete search history.

(56) References Cited

U.S. PATENT DOCUMENTS 4,389,758 A * 6/1983 Akashi ..... A44B 19/262 24/429
5,068,950 A * 12/1991 Yuki ..... A44B 19/262 24/429

(Continued)

FOREIGN PATENT DOCUMENTS

CN 206641468 U 11/2017
EP 1 415 563 A1 5/2004

(Continued)

OTHER PUBLICATIONS

International Search Report, PCT Application No. PCT/JP2018/028610, dated Sep. 11, 2018.

(Continued)

*Primary Examiner* — Robert Sandy
*Assistant Examiner* — Louis A Mercado
(74) *Attorney, Agent, or Firm* — Kilpatrick Townsend & Stockton LLP

(57) ABSTRACT

A slider for a slide fastener useable with a slider with an automatic stop function to secure a tab to enable automatic engagement and prevent swinging of the tab, regardless of the type of tab, when the tab is tilted to an engaged portion side. An engaging portion is formed in an attachment hole of the tab. An engaged portion is formed in the slider body or the tab attachment part. When the tab is tilted to be almost parallel to an upper blade on the engaged portion side of the tab attachment part, due to a biasing force of the spring member, the lock pin moves the shaft portion of the tab downward and to an opposite side of a tilted direction, and a tip portion of the engaging portion of the tab is pulled into to be engaged with the engaged portion side of the tab attachment part.

10 Claims, 10 Drawing Sheets

(56) References Cited

U.S. PATENT DOCUMENTS

| | | | | |
|---|---|---|---|---|
| 6,237,199 | B1 | 5/2001 | Chou Wang | |
| 7,574,783 | B2 * | 8/2009 | Muratsubaki | A44B 19/262 24/429 |
| 8,677,574 | B1 * | 3/2014 | Thiessen | A44B 19/262 24/429 |
| 8,931,145 | B1 * | 1/2015 | Liao | A44B 19/262 24/429 |
| 9,095,192 | B2 * | 8/2015 | Hamada | A44B 19/303 |
| 10,194,719 | B2 * | 2/2019 | Li | A44B 19/262 |
| 10,765,177 | B2 * | 9/2020 | Hamada | A44B 19/26 |
| 10,905,204 | B2 * | 2/2021 | Kondo | A44B 19/42 |
| 2009/0276985 | A1 * | 11/2009 | Kim | A44B 19/262 24/431 |
| 2014/0082896 | A1 * | 3/2014 | Li | A44B 19/308 24/424 |
| 2015/0321399 | A1 * | 11/2015 | Hong | C08L 75/04 524/539 |
| 2020/0205529 | A1 * | 7/2020 | Lin | B21D 53/54 |

FOREIGN PATENT DOCUMENTS

| | | | |
|---|---|---|---|
| JP | S58-100611 | U | 7/1983 |
| JP | S62-102407 | U | 6/1987 |
| JP | 3135346 | U | 8/2007 |
| JP | 3205204 | U | 6/2016 |
| WO | 2015/063937 | A1 | 5/2015 |

OTHER PUBLICATIONS

Extended European Search Report, European Patent Application No. 18928564.6, dated Jul. 16, 2021,7 pages.

* cited by examiner

SLIDER FOR SLIDE FASTENER

TECHNICAL FIELD

The invention relates to a slider for a slide fastener.

BACKGROUND ART

Regarding a slide fastener, left and right element rows are separated and coupled by sliding a slider along the left and right element rows attached on side edges facing each other of a pair of fastener tapes. In general, the slider mainly includes a slider body including an upper blade and a lower blade with front end sides connected by a diamond at a predetermined space, a tab including a knob portion for operating the slider, and a tab attachment part attached to make the tab movable and rotatable between the tab attachment part and the upper blade of the slider body.

In addition to the above sliders, a so-called automatic slider including a lock pin (locking pawl) and a spring member as an automatic stop mechanism of the slider is also known. In the automatic slider, when a hand is released from the tab at the time of non-operation of the slider, the pawl body of the lock pin is engaged with the elements at the stop position of the slider, and the slider is automatically locked and can be held by the lock pin not to slide the slider. The slider is made slidable by pulling the tab to release the lock.

Patent Document 1 discloses a slider for a slide fastener including an elongated recess for sandwiching either a front part or a rear part of the tab attachment part in a through hole of a connecting portion of the tab, and the recess sandwiches the tab attachment part, so that the tab can be temporarily secured not to be pivotable.

In addition, Patent Document 2 discloses a slider for a slide fastener configured such that elastic deformation of a through hole of a connecting portion of a tab causes the tab to move beyond a projecting portion on a rear surface of a post portion of a tab attachment part, and the tab can be snap-stopped on the body or the post portion, so that the tab can be temporarily secured not to be rotatable.

Further, regarding a slider with an automatic stop function of a retrofitted type of a tab of Patent Document 3, Patent Document 3 discloses the above automatic slider, in which when a hand is released from the tab at the time of non-operation of the slider, a pawl body of a lock pin is engaged with the elements at the stop position of the slider. Snap-engagement between an engagement projecting portion of the tab and a front edge of the slider body secures the tab to prevent swinging of the tab, so that the tab can be temporarily secured not to be rotatable.

CITATION LIST

Patent Document

Patent Document 1: CN 206641468 U
Patent Document 2: JP 3135346 U
Patent Document 3: JP 3205204 U

SUMMARY OF INVENTION

Technical Problem

In the slider of the above Patent Document 1, an attachment hole formed in the connecting portion of the tab and causing the tab attachment part to pass through is formed to be sufficiently large. Hence, the tab is a so-called "pivot tab" that is pivotable in the width direction of the slide fastener with the tab attachment part as the center. The recess of the tab sandwiches the tab attachment part, so that the pivotable tab can be temporarily secured not to be pivotable. However, in order to secure the tab, an operation of a user is needed to turn the recess of the tab to the insertion portion of the tab attachment part, and then move the recess in a direction to be engaged with the insertion portion, that is, to the front side in a front and rear direction of the slider.

In addition, the slider of the above Patent Document 2 can be snap-stopped near the end of the post portion by the tab rotating beyond the projecting portion. However, in the automatic securing configuration of the tab of the slider of the above Patent Document 2, the tab configured not to be pivotable in the width direction, which is a so-called "angular tab", is set to be a condition, and is not applicable to the "pivot tab" as disclosed in Patent Document 1. Further, the "angular tab" cannot be used by pivoting the tab, and its applications may be limited. For example, in a case where a slide fastener extending in a horizontal direction is provided on a pocket arranged on an upper part of a garment such as a coat, when the slider of Patent Document 2 is applied, the tab cannot be pulled by pivoting the tab. Hence, while a user wears such a garment, the user has to raise the hand high and move the tab in the horizontal direction in order to pull the tab. Therefore, the force is hardly exerted.

Regarding the slider of the above Patent Document 3, the tab can be automatically secured by the snap-engagement between the engagement projecting portion of the tab and the front edge of the slider body, in a state where the tab is rotated to the front side in the front and rear direction of the slider. However, the slider of the above Patent Document 3 is also configured such that the tab is not pivotable, which is a so-called "angular tab", is set to a condition in the same manner as Patent Document 2, and therefore is not applicable to the "pivot tab" as disclosed in Patent Document 1. As described above, the tab cannot be used by pivoting from the front and rear direction, and its applications may be limited. Further, in the slider of the above Patent Document 3, the tab is secured only in a state where the tab is tilted down on the diamond side.

The invention has been made in view of the above circumstances, and has an object to provide a slider for a slide fastener capable of coping with a slider with an automatic stop function, and capable of securing a tab to enable automatic engagement and preventing swinging of the tab, regardless of the type of the tab, when the tab is tilted to an engaged portion side.

Solution to Problem

A slider for a slide fastener according to one aspect of the invention includes: a slider body including an element passage formed by an upper blade and a lower blade, the upper blade and the lower blade being connected by a diamond; a tab attachment part provided on an upper surface of the upper blade; a tab including a knob portion, and a connecting portion including a shaft portion mounted on the upper surface of the upper blade and connected with the tab attachment part; a lock pin provided above the shaft portion in the upper blade, and including a pawl portion; and a spring member for biasing the pawl portion of the lock pin to enter the element passage from a pawl hole provided in the upper blade, the slider being characterized in that the tab attachment part is a cover member, an attachment hole for causing the tab attachment part to pass through is formed in the connecting portion of the tab, and an engaging portion projecting toward the shaft portion from an edge portion on the knob portion side of the attachment hole is formed in the tab, an engaged portion is formed on the slider body or at least one of a front wall and a rear wall in a front and rear direction of the tab attachment part, and in a case where the tab is tilted to be almost parallel to the upper blade on the engaged portion side of the tab attachment part, due to a biasing force of the spring member, the lock pin moves the shaft portion of the tab downward and to an opposite side of a tilted direction, and a tip portion of the engaging portion of the tab is pulled into to be engaged with the engaged portion side of the tab attachment part.

Further, in the slider for the slide fastener in another embodiment, the upper blade includes a mounting surface on which the shaft portion is mounted, and an inclined surface extending obliquely upward is provided on a front side or/and a rear side in the front and rear direction of the mounting surface to correspond to the engaged portion formed in the tab attachment part, and in the case where the tab is tilted to be almost parallel to the upper blade on the engaged portion side of the tab attachment part, due to the biasing force of the spring member, the shaft portion of the tab moves downward and to the opposite side of the tilted direction along the inclined surface.

Further, in the slider for the slide fastener in another embodiment, the connecting portion is formed of a metal, and the knob portion and the engaging portion are integrally formed with a resin, and are provided in the connecting portion to cover at least a part of the connecting portion.

Further, in the slider for the slide fastener in another embodiment, the knob portion and the engaging portion are formed in the connecting portion by injection molding.

Further, in the slider for the slide fastener in another embodiment, the tab is attached to the slider body to be freely pivotable in a width direction.

Further, in the slider for the slide fastener in another embodiment, the engaging portion has a projecting shape including the tip portion, and the engaged portion has a recessed shape for accommodating the tip portion.

Further, in the slider for the slide fastener in another embodiment, while the tab is being tilted to be almost parallel to the upper blade, the tab attachment part is formed to contact the engaging portion.

Further, in the slider for the slide fastener in another embodiment, the engaging portion includes a projection base portion, and a width of the projection base portion is larger than a width of the engaged portion in a width direction.

Further, in the slider for the slide fastener in another embodiment, a hole portion or a recess portion is formed in a part covered with the knob portion in the connecting portion.

Further, in the slider for the slide fastener in another embodiment, the slider body includes a front attachment post and a rear attachment post for attaching the tab attachment part, and the engaged portion is formed on each the front attachment post and the rear attachment post of the slider body or each the front wall and the rear wall of the tab attachment part in the front and rear direction of the slider.

Advantageous Effects of Invention

According to the invention, it is possible to provide a slider for a slide fastener capable of coping with a slider with an automatic stop function, and capable of securing a tab to enable automatic engagement and preventing swinging of the tab, regardless of the type of the tab, when the tab is tilted to an engaged portion side.

BRIEF DESCRIPTION OF DRAWINGS

FIG. 5(*b*) is a perspective view of a connecting portion of the tab in which a knob portion of the tab is omitted.

FIG. 6(*b*) is a perspective view from the bottom of the tab attachment part.

FIG. 7(*b*) is a cross-sectional view showing a situation from the used state where the tab is pulled rearward to the engagement state.

FIG. 7(*c*) is a cross-sectional view showing a situation from the used state where the tab is pulled rearward to the engagement state.

FIG. 7(*d*) is a cross-sectional view showing a situation from the used state where the tab is pulled rearward to the engagement state.

FIG. 8(*b*) is a cross-sectional view showing a situation from the used state where the tab is pulled frontward to the engagement state.

FIG. 8(*c*) is a cross-sectional view showing a situation from the used state where the tab is pulled frontward to the engagement state.

FIG. 8(*d*) is a cross-sectional view showing a situation from the used state where the tab is pulled frontward to the engagement state.

FIG. 9(*b*) is a cross-sectional view of a slider including the tab of FIG. 9(*a*).

DESCRIPTION OF EMBODIMENTS

Hereinafter, a slider for a slide fastener according to embodiments of the invention will be described with reference to FIGS. 1 to 9. It is to be noted that the invention is not limited to the embodiments to be described below, and various changes can be made as long as it has substantially the same configuration as the invention and has the same functions and effects.

Figure 1:
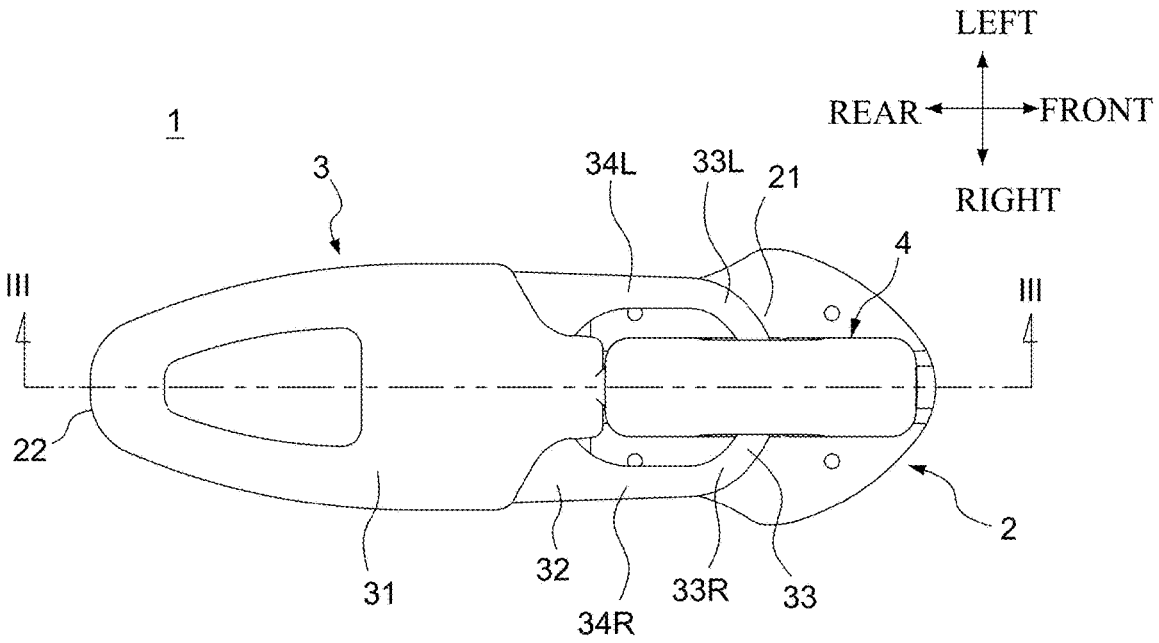
FIG. 1 is a plan view of a slider according to an embodiment of the invention, and shows a state where a tab is engaged on a rear opening side.
Figure 2:
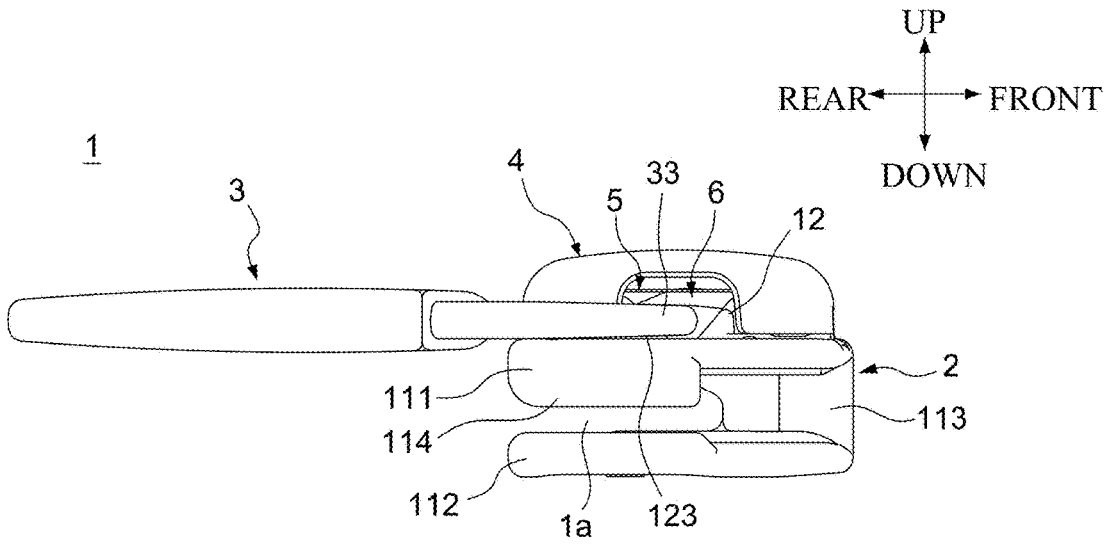
FIG. 2 is a side view of FIG. 1.

In the following description, as shown in FIG. 1, a front and rear direction of a slider 1 (hereinafter, simply referred to as a "front and rear direction") denotes a direction corresponding to the moving direction of the slider 1. It is to be noted that when the slider 1 is moved, a direction of closing a pair of fastener stringers (not shown) is a front side (shoulder opening), and a direction of opening the pair of fastener stringers is a rear side (rear opening). In addition, a left and right direction of the slider 1 (hereinafter, simply referred to as a left and right direction) denotes a direction orthogonal to the front and rear direction in a plan view of the slider 1. Further, as shown in FIG. 2, an up and down direction of the slider 1 denotes a direction orthogonal to the front and rear direction and the left and right direction. The slide fastener (not shown) includes, for example, a pair of fastener stringers and the slider 1. In the pair of fastener stringers, a single row of fastener elements (not shown) is attached at each of tape side edges facing each other of a pair of fastener tapes (not shown). The left and right fastener stringers are closed by a frontward movement of the slider 1, and the left and right fastener elements are brought into a coupled state. Further, the left and right fastener stringers are opened by a rearward movement of the slider 1, and the left and right fastener elements are brought into an uncoupled state.

First Embodiment

Figure 3:
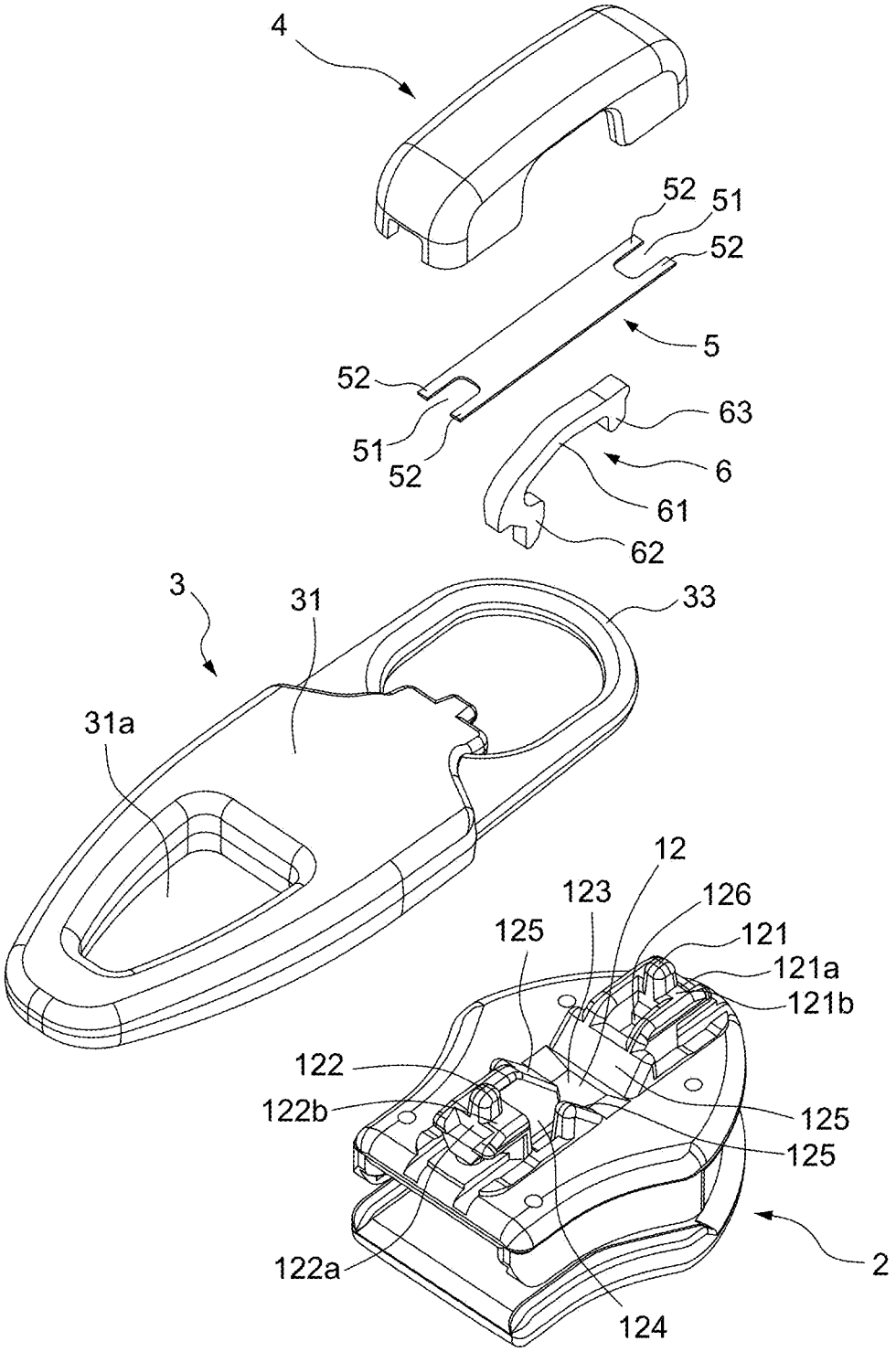
FIG. 3 is an exploded perspective view of the slider according to an embodiment of the invention.
Figure 4:
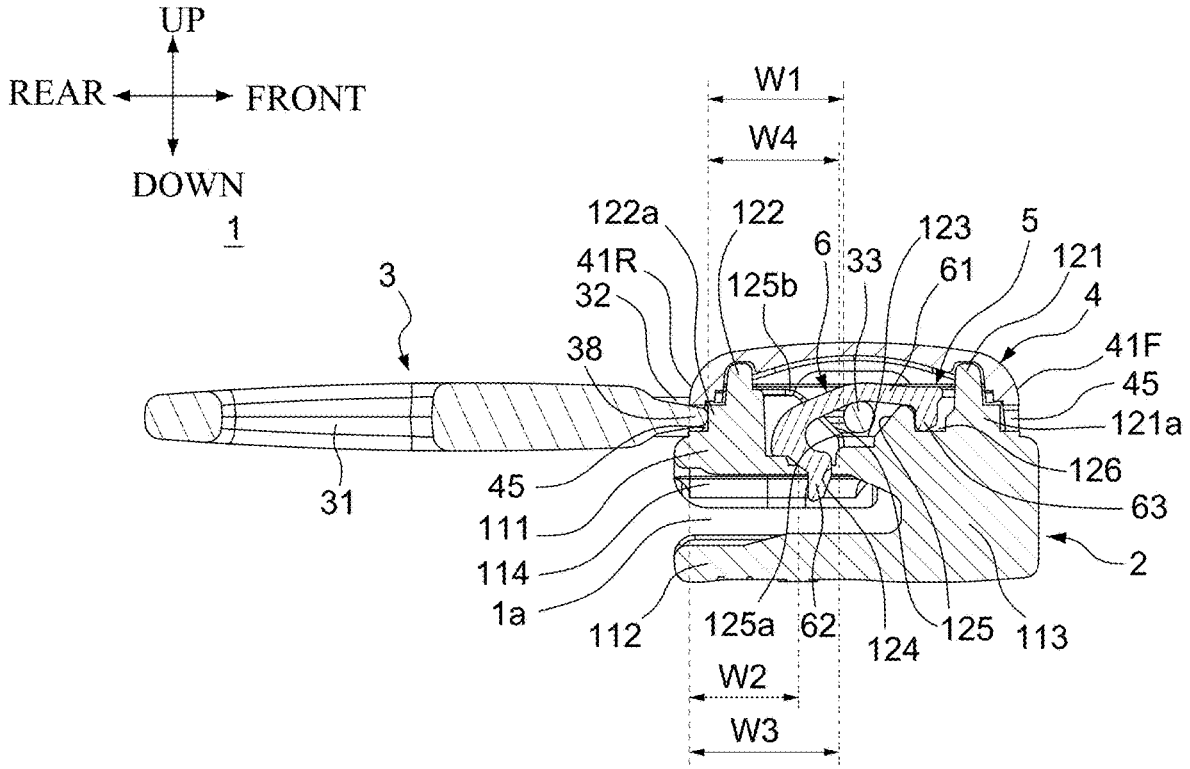
FIG. 4 is a cross-sectional view taken along line of FIG. 1.

Hereinafter, the general arrangement of the slider 1 for the slide fastener of the invention will be described with reference to FIGS. 1 to 4. FIG. 1 is a plan view of a slider according to an embodiment of the invention, and shows a state where the tab is tilted rearward. FIG. 2 is a side view of FIG. 1. FIG. 3 is an exploded perspective view of the slider 1 of FIG. 1. FIG. 4 is a cross-sectional view taken along line of FIG. 1.

Slider Body

As shown in FIGS. 1 to 4, the slider 1 includes a slider body 2, a tab 3, a tab attachment part 4, a spring member 5, and a lock pin 6. The slider body 2 includes a tab mounting portion 12 provided on an upper side of the slider body 2. A mounting surface 123 and an inclined surface 125 for mounting a shaft portion 33 of the tab 3 are provided in the tab mounting portion 12. As shown in FIGS. 2 and 4, the slider body 2 includes an upper blade 111 and a lower blade 112, which are separated from each other and parallel to each other in the up and down direction, a diamond 113 connecting the upper blade 111 and the lower blade 112 at a front end, and a flange 114 projecting along both left and right side edges of at least one of the upper blade 111 and the lower blade 112. It is to be noted that in the present embodiment, a plate spring is used as an example of the spring member 5. However, as will be described later, the spring member 5 may not necessarily be a plate spring, and may be a coil spring or another type of elastic member. Furthermore, the spring member 5 may be formed integrally with the tab attachment part 4 or the lock pin 6, instead of a separate member.

The tab 3 is rotatable in the front and rear direction with respect to the slider body 2 with the shaft portion 33 as the center of rotation. The tab attachment part 4 is provided on the upper blade 111 of the slider body 2 to cover the shaft portion 33 of the tab 3 from above in order to attach the tab 3 to the slider body 2. The lock pin 6 is provided above the shaft portion 33 of the tab 3 in the inside of the tab attachment part 4, that is, the lock pin 6 is provided between the shaft portion 33 of the tab 3 and the tab attachment part 4. It is to be noted that as will be described later, the slider 1 can be automatically switched to a stop state by cooperation of the spring member 5 and the lock pin 6.

The slider body 2 is configured to move along left and right fastener element rows (not shown), and to enable the left and right fastener elements to be brought into a coupled state and an uncoupled state in the moving process.

The slider body 2 further includes, on the upper surface of the upper blade 111, a front attachment post 121 and a rear attachment post 122, which respectively project upward on the front side and the rear side of an intermediate part in the left and right direction, and which are arranged for attaching the tab attachment part 4. The mounting surface 123 for mounting the shaft portion 33 of the tab 3 is provided between the front attachment post 121 and the rear attachment post 122. In addition, support surfaces 121*b* and 122*b* for supporting support pieces 52, to be described later, of the spring member 5 are formed on respective base portions 121*a* and 122*a* of the front attachment post 121 and the rear attachment post 122. In the present embodiment, the tab mounting portion 12 including the mounting surface 123 and the inclined surface 125, the front attachment post 121, and the rear attachment post 122 are provided integrally with the slider body 2, but may be attached to the slider body 2 after being formed separately from the slider body 2.

As shown in FIGS. 3 and 4, the tab mounting portion 12 includes the inclined surface 125 on at least one of the front side and the rear side of the mounting surface 123 in the front and rear direction. More specifically, the inclined surface 125 is provided on either the front side or the rear side or both the front side and the rear side of the mounting surface 123 in the front and rear direction to correspond to an engaged portion 45, which is formed on at least one of a front wall 41F and a rear wall 41R in the front and rear direction of the tab attachment part 4 to be described later. The inclined surface 125 is formed to extend obliquely upward. The inclined surface 125 includes a lower edge 125*a* continuous with the mounting surface 123, and an upper edge 125*b* on the opposite side of the lower edge 125*a*. In the present embodiment, the inclined surface 125 is formed like an inclined plane, as shown in FIGS. 3 and 4. However, as long as the inclined surface 125 is formed to extend obliquely upward, the inclined surface 125 may be a concave surface or a convex surface. In addition, the inclined surface 125 may be a plane formed continuously in the left and right direction like the inclined surface 125 on the shoulder opening side as shown in FIG. 3, or may be formed of a plurality of inclined surfaces at intervals like the inclined surface 125 on the rear opening side as shown in FIG. 3. In short, any shape of the inclined surface may be applicable, as long as the inclined surface 125 on the rear side of the mounting surface 123 is capable of guiding the shaft portion 33 of the tab 3 to move frontward as moving downward, and on the other hand, as long as the inclined surface 125 on the front side of the mounting surface 123 is capable of guiding the shaft portion 33 of the tab 3 to move rearward as moving downward.

FIG. 4 is a cross-sectional view taken along line III-III of FIG. 1 in a state where an engaging portion 38 of the tab 3 is engaged on the rear opening side. As shown in FIG. 4, in a state where the engaging portion 38 of the tab 3 is engaged on the rear opening side that is an engaged portion side, a dimension W1 from the tip of the engaging portion 38 to the shaft portion 33 of the tab 3 (FIG. 5) is equal to or larger than a dimension W2 from the rear wall 41R of the tab attachment part 4 to the upper edge 125*b* of the inclined surface 125 in the front and rear direction. The dimension W1 from the tip of the engaging portion 38 to the shaft portion 33 of the tab 3 is equal to or smaller than a dimension W3 from the rear wall 41R of the tab attachment part 4 to the lower edge 125*a* of the inclined surface 125 in the front and rear direction. That is, the relationship $W3 \geq W1 \geq W2$ is satisfied, and preferably, $W3 > W1 > W2$ is satisfied. In addition, the dimension W1 from the tip of the engaging portion 38 to the shaft portion 33 of the tab 3 is equal to or larger than a dimension W4 from the base portion 122*a*, which is a depth part, to be described later, of the engaged portion 45, to the lower edge 125*a* of the inclined surface 125 in the front and rear direction. That is, W1≥W4 is satisfied, and preferably W1>W4 is satisfied.

The upper blade 111 and the lower blade 112 are both plates in which the up and down direction is a thickness direction. In the upper blade 111, at a position between the front attachment post 121 and the rear attachment post 122 and closer to the front attachment post 121, a recess portion 126 for swinging is fitted in the up and down direction by a lock pin base portion 63, which will be described later, of the lock pin 6, and which serves as a center part of swinging of the lock pin 6.

An element passage 1*a* for causing a pair of element rows to pass through is formed between the upper blade 111 and the lower blade 112. The upper blade 111 includes a pawl hole 124 between the front attachment post 121 and the rear attachment post 122 and at a position closer to the rear attachment post 122 so as to cause a pawl portion 62, to be described later, of the lock pin 6 to enter the element passage 1*a*. The pawl hole 124 is a hole penetrating through the upper blade 111 in the up and down direction that is the thickness direction of the upper blade 111.

Tab

Figure 5A:
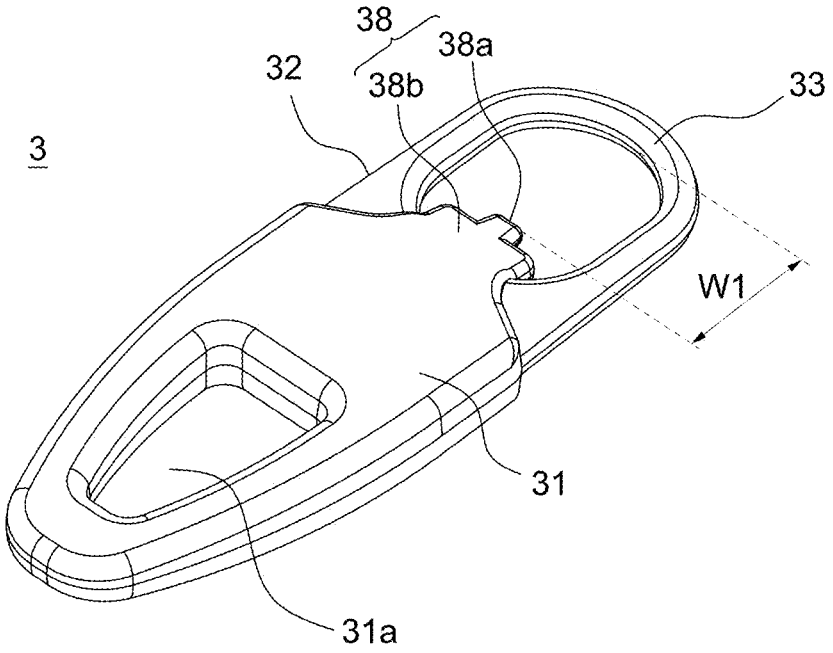
FIG. 5(*a*) is a perspective view of the tab.
Figure 5B:
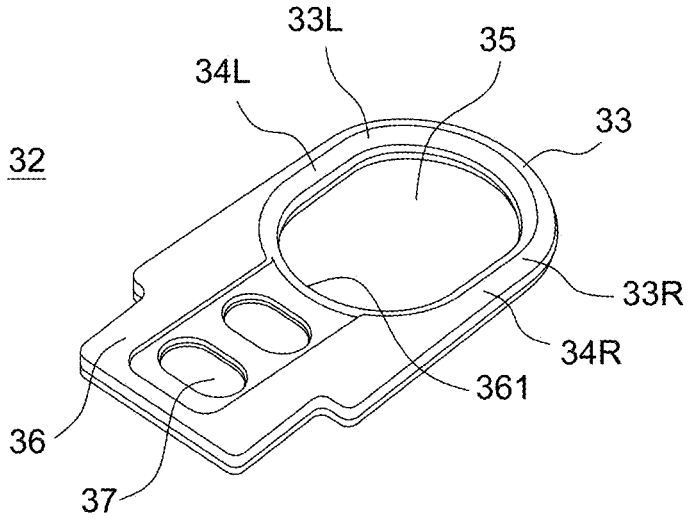

FIG. 5(*a*) is a perspective view of the tab, and FIG. 5(*b*) is a perspective view of a connecting portion 32 of the tab 3 in which a knob portion 31 of the tab 3 of FIG. 5(*a*) is omitted. As shown in FIGS. 1, 5(*a*), and 5(*b*), the tab 3 includes the knob portion 31, which is a free end, and the connecting portion 32, which is a base end connected with the tab attachment part 4. The connecting portion 32 includes the shaft portion 33, and a pair of rod portions 34L and 34R respectively extending from both ends 33L and 33R of the shaft portion 33 to the handle portion 31 side. As shown in FIG. 2, the tab 3 is rotatable in the front and rear direction with respect to the slider body so that the shaft portion 33 serves as the center of rotation.

The knob portion 31 of the tab 3 can be manufactured by injection molding, for example, a TPU (thermoplastic polyurethane resin). Further, the connecting portion 32 of the tab 3 is formed of, for example, an aluminum alloy, a copper alloy, a zinc alloy, brass, stainless steel, or the like by a press working means, or is molded by an injection molding means by using a hard resin such as nylon.

Preferably, the knob portion 31 of the tab 3 is formed of a resin, and the connecting portion 32 is formed of a metal. More preferably, the connecting portion 32 is formed of a material harder than the knob portion 31. However, the knob portion 31 and the connecting portion 32 may be formed of the same material, and the materials of the knob portion 31 and the connecting portion 32 are not limited. Furthermore, the tab 3 may be integrally formed.

As shown in FIG. 5(*a*), a knob hole 31*a* is formed in the knob portion 31. The provision of the knob hole 31*a* allows a finger to hold the knob portion 31 easily, and suppresses the use amount of the material of the knob portion 31.

As shown in FIG. 5(*b*), the connecting portion 32 includes a connection base portion 36 to be connected with the knob portion 31. In the connecting portion 32, an attachment hole 35, through which the tab attachment part 4 is inserted, is defined by the shaft portion 33, the pair of rod portions 34L and 34R, and the connection base portion 36. In the present embodiment, the shaft portion 33 is formed in a substantially circular arc shape as shown in FIG. 5(*b*). In addition, in the present embodiment, the diameter of the attachment hole 35 defined by the shaft portion 33, the pair of rod portions 34L and 34R, and the connection base portion 36 is sufficiently large. More specifically, the width of the attachment hole 35 in the left and right direction is sufficiently larger than the width of the tab attachment part 4 in the left and right direction. Therefore, when the tab 3 is attached to the tab attachment part 4, the tab 3 is freely pivotable in the width direction of the slide fastener with the tab attachment part 4 as the center. That is, in the present embodiment, the tab 3 is a pivotable tab, a so-called pivot tab. As one of advantages of the pivot tab, for example, when a slider with a pivot tab is applied to a pocket of a garment opened in the lateral direction, the tab 3 is released from the secured state and then the tab 3 is pivoted downward with respect to the slider body. Thus, the tab 3 can be pulled by a hand from a lower position. This eliminates the need for pulling the tab 3 by raising the hand high to move the tab in the horizontal direction while a user wears the garment. Therefore, the convenience of the tab 3 can be improved. However, the shaft portion 33 may be formed in a straight line, instead of a circular arc. In addition, the cross-sectional shape of the shaft portion 33 may be formed into a triangle, a rectangle, a square, a trapezoid, or the like. Further, as long as the tab 3 is pivotable with respect to the slider body 2, the connecting portion 32 may have any shape.

As shown in FIG. 5(*b*), in the connection base portion 36, hole portions 37 for rigidly connecting the knob portion 31 are arranged. The tab 3 is formed to cover at least a part of the connection base portion 36 and the hole portions 37, when the knob portion 31 is formed by injecting a resin. Accordingly, by covering the hole portions 37 of the connection base portion 36 with the knob portion 31, the resin injected on the front surface and the back surface of the connection base portion 36 can be combined with each other through the hole portions 37, and accordingly, the knob portion 31 is capable of grasping the connecting portion 32 more firmly and the tab 3 can be formed more strongly. It is to be noted that a recess that does not penetrate through or a projection may be provided on the connection base portion 36. In addition, the hole portions 37 may not necessarily be provided in the connection base portion 36.

As shown in FIG. 5(*a*), the engaging portion 38 projecting toward the shaft portion 33 is formed in the tab 3 from an edge portion on the knob portion 31 side of the attachment hole 35. The knob portion 31 covers the connection base portion 36 to reach an edge portion 361 on the connection base portion 36 side of the attachment hole 35. The engaging portion 38 is formed to extend from the edge portion 361 on the connection base portion 36 side of the attachment hole 35 toward the shaft portion 33. The engaging portion 38 is engaged with the engaged portion 45 formed in the slider body 2 or the tab attachment part 4.

As shown in FIG. 5(*a*), in the present embodiment, since the engaging portion 38 is formed in a "projecting" shape, the engaging portion 38 includes a projection base portion 38*b* and a tip portion 38*a*. The projection base portion 38*b* projects from the edge portion 361 on the knob portion 31 side of the attachment hole 35 toward the shaft portion 33, and has a width larger than the width of the engaged portion 45 in the left and right direction. The tip portion 38*a* extends from the center on the front side of the projection base portion 38*b*, and has a width engageable with the engaged portion 45.

As shown in FIG. 5(*a*), the engaging portion 38 is formed integrally with the knob portion 31. However, the engaging portion 38 may not necessarily be formed integrally with the knob portion 31, and may be separately formed on the connecting portion 32. Therefore, the engaging portion 38 may be formed of the same material with the knob portion 31, and may be formed of a different material. The engaging portion 38 is preferably formed of a material having an elastic force. However, the tip of the engaging portion 38 may have any shape as long as it is engageable with the engaged portion 45, and may be, for example, a triangle or a rectangle.

Tab Attachment Part

Figure 6:
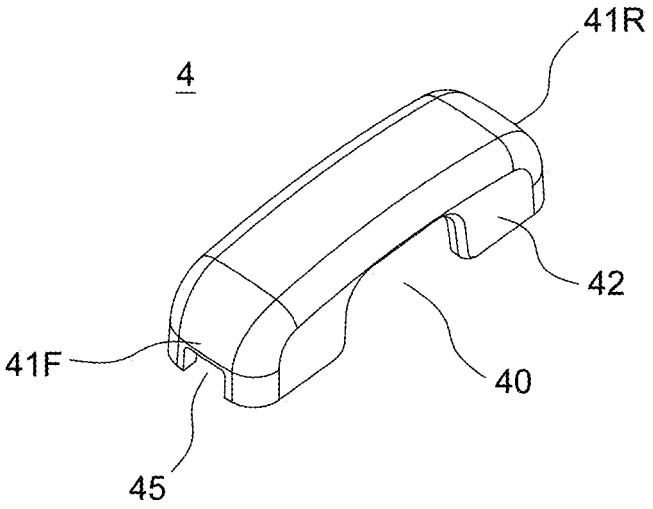
FIG. 6(*a*) is a perspective view of a tab attachment part.
Figure 6B:
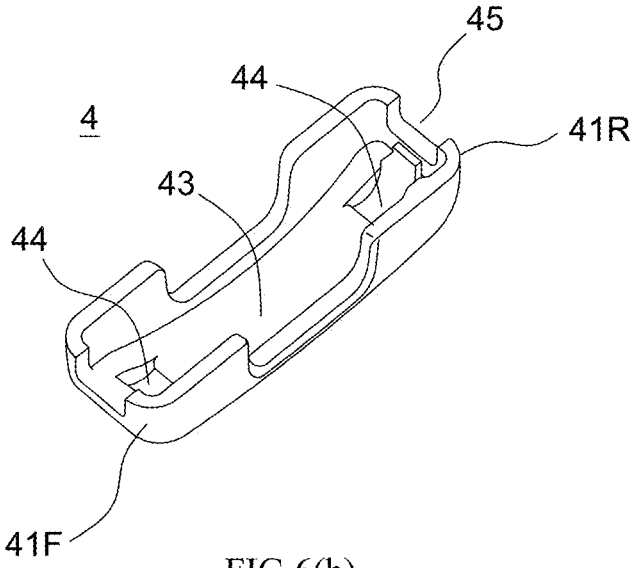
Figure 7A:
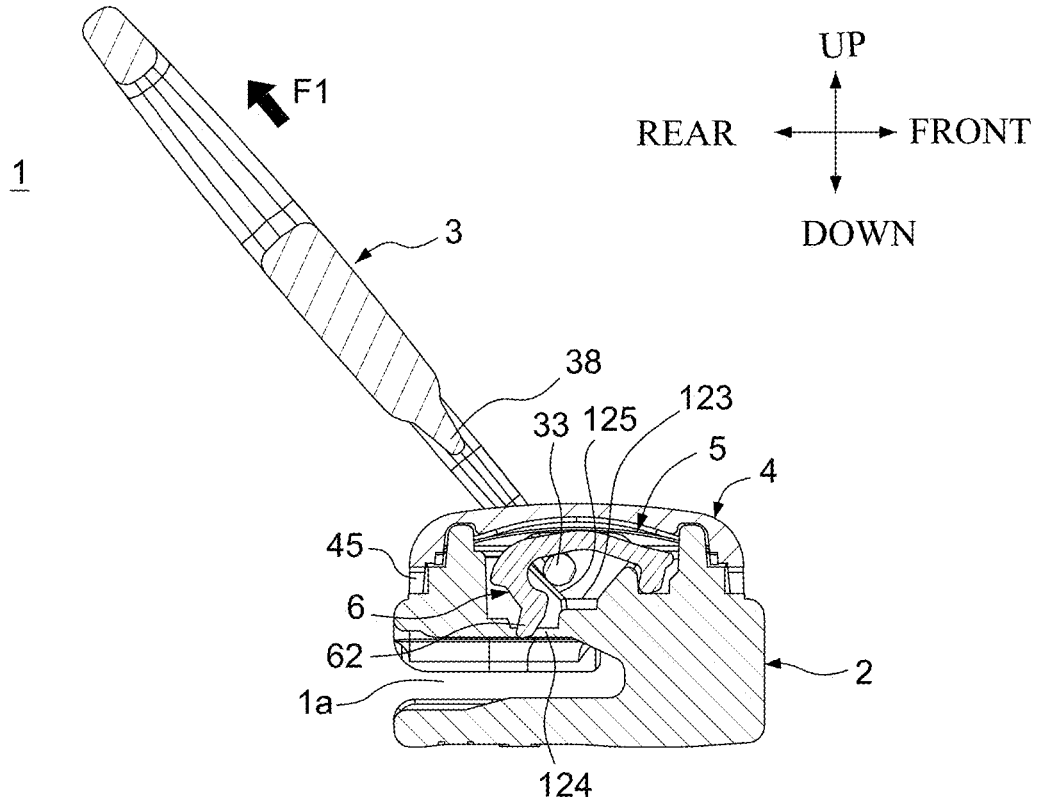
FIG. 7(*a*) is a cross-sectional view showing a situation from a used state where the tab is pulled rearward to an engagement state.
Figure 7:
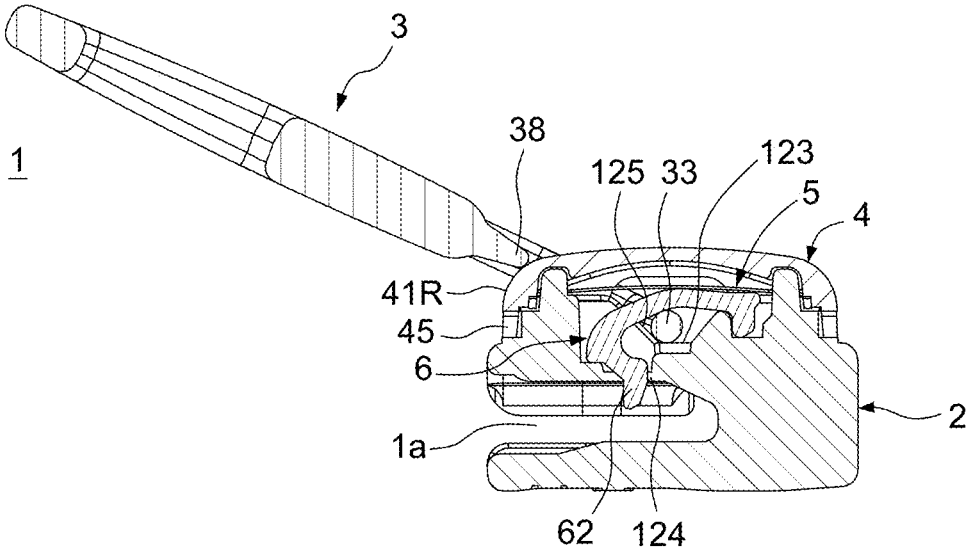
Figure 7C:
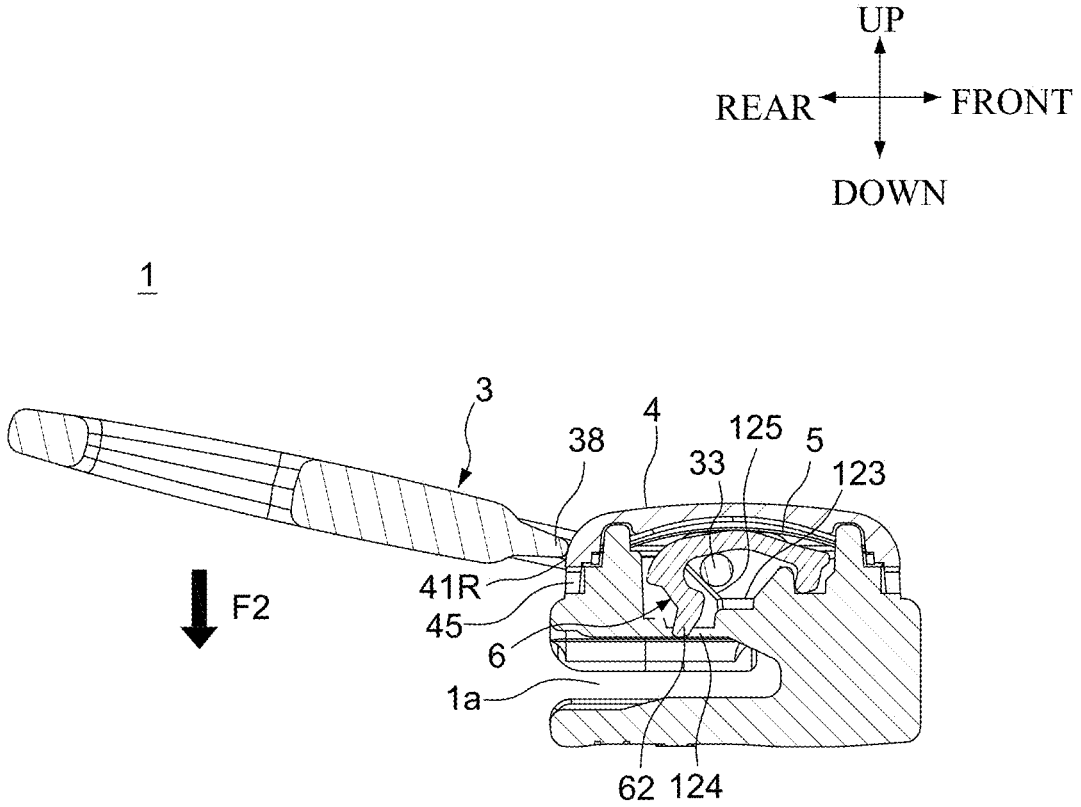
Figure 7:
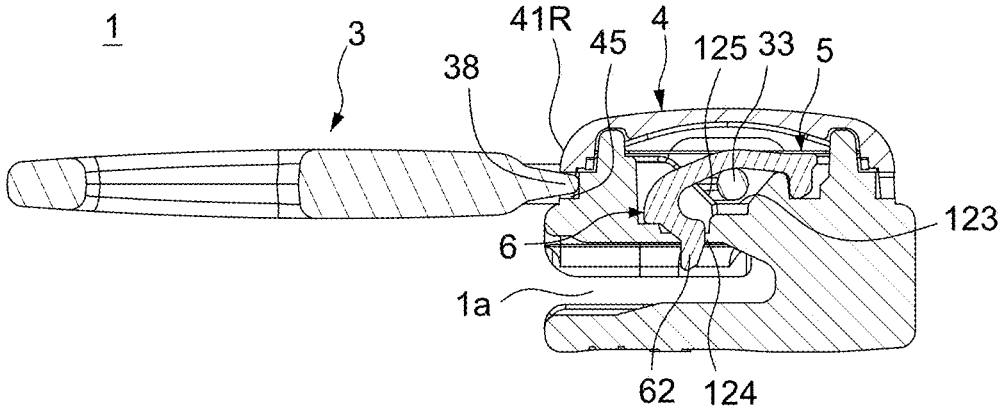
Figure 8A:
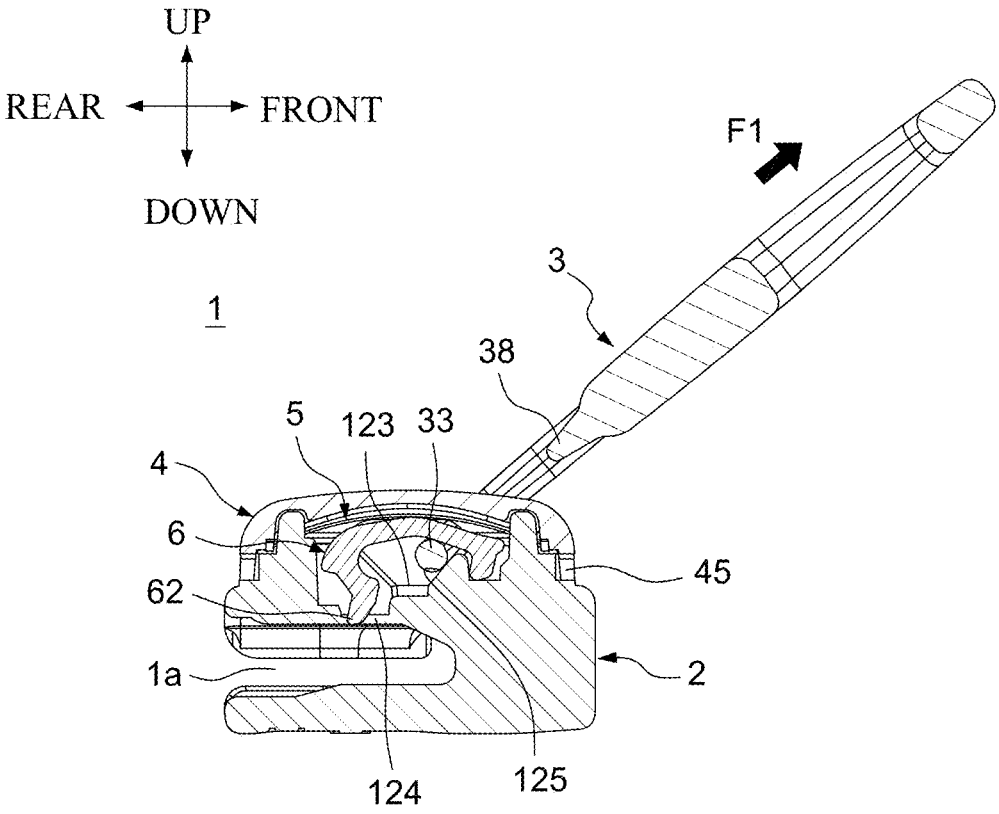
FIG. 8(*a*) is a cross-sectional view showing a situation from a used state where the tab is pulled frontward to an engagement state.
Figure 8B:
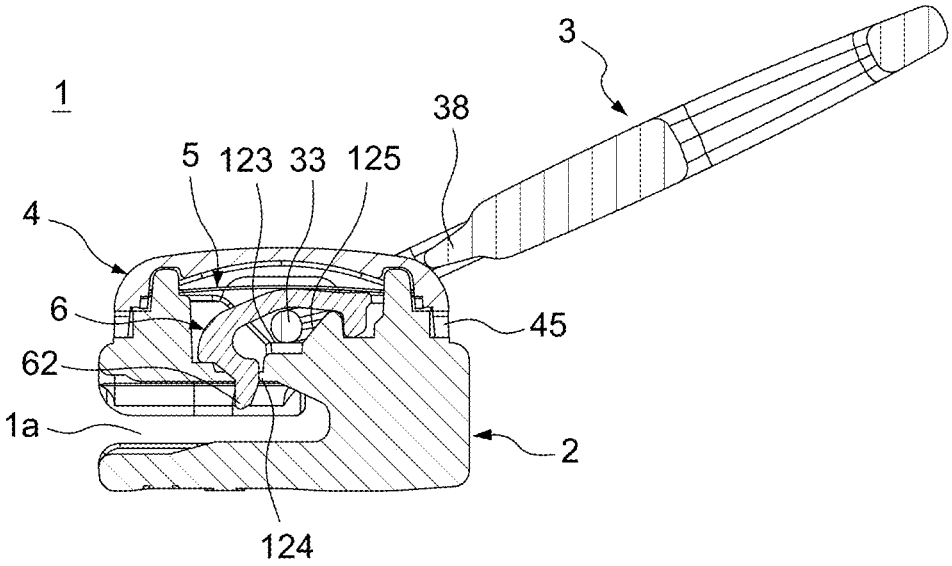
Figure 8C:
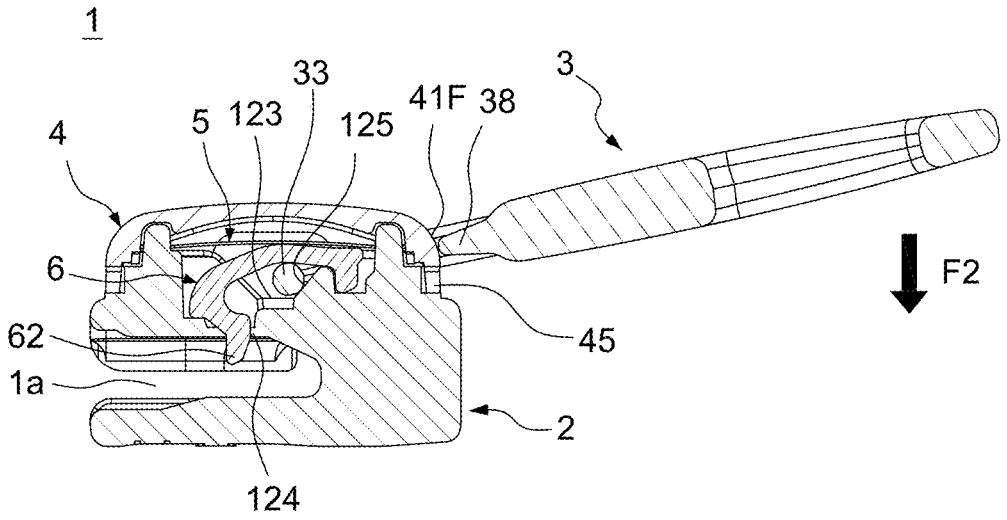
Figure 8D:
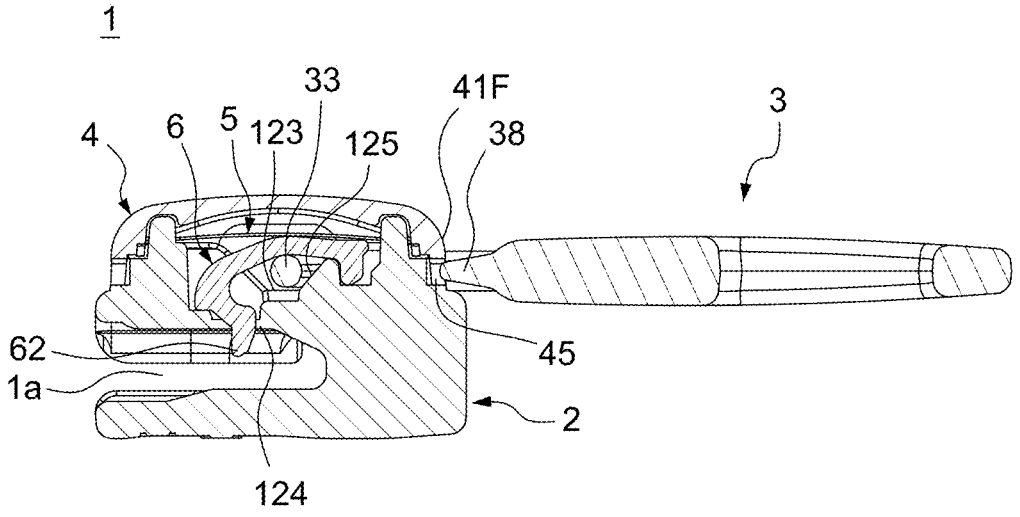

FIG. 6(*a*) is a perspective view of the tab attachment part 4. As shown in FIGS. 2 and 6(*a*), the tab attachment part 4 is formed to be a cover member having a container-like shape that opens on the lower side, and has a tunnel shape through which the central part is penetrated in a side view. The tab attachment part 4 includes the front wall 41F, the rear wall 41R, and side walls 42. The front wall 41F and the rear wall 41R of the tab attachment part 4, in a state of being attached to the slider body 2 together with the tab attachment part 4 and the tab 3, are formed to contact the engaging portion 38 of the tab 3 while the tab 3 is being tilted to be almost parallel to the upper blade 111 from a tilted state where the tab 3 is rotatable as shown in FIG. 7(*c*). Accordingly, when the engaging portion 38 is tilted from the tilted state of being rotatable, by contacting the tab attachment part 4, a clicking feel and a steady feel can be further given to a user. However, the effects of the invention are obtainable by forming without contacting. In addition, an opening portion 40 for causing the shaft portion 33 of the tab 3 to pass through is provided on the side walls 42 of the tab attachment part 4. In the present embodiment, the opening portion 40 is formed to open downward. However, the opening portion 40 of the side walls 42 may be formed to be a hole portion, instead of opening downward.

FIG. 6(*b*) is a perspective view from the bottom of the tab attachment part 4. As shown in FIG. 6(*b*), the tab attachment part 4 includes an inner wall 43. The inner wall 43 of the tab attachment part 4 includes attachment recess portions 44 to be attached to the front attachment post 121 and the rear attachment post 122 respectively at positions closer to the front wall 41F and the rear wall 41R at an intermediate part in the left and right direction. The tab attachment part 4 is attached to the front attachment post 121 and the rear attachment post 122 so as to respectively engage the attachment recess portions 44 with the front attachment post 121 and the rear attachment post 122. Furthermore, the tab attachment part 4 is secured to the front attachment post 121 and the rear attachment post 122 by caulking processing at four places on the front, rear, left, and right of the side walls 42.

As shown in FIGS. 4, 6(*a*), and 6(*b*), in the present embodiment, the tab attachment part 4 is a cover member. Since the tab attachment part 4 covers the spring member 5, the lock pin 6, and the shaft portion 33 of the tab 3 from above in this order, the spring member 5, the lock pin 6, and the shaft portion 33 of the tab 3 are arranged in this order in the inside of the tab attachment part 4 as the cover member. Accordingly, the shaft portion 33 of the tab 3, the spring member 5, and the lock pin 6 in the inside of the tab attachment part 4 can be held and protected, and additionally, the tab 3 can be rotated and pivoted. However, as long as the shaft portion 33 of the tab 3, the spring member 5, and the lock pin 6 can be attached to the slider body 2, the tab attachment part 4 may not necessarily be the cover member. For example, in the tab attachment part 4, the side walls 42 may be omitted.

As shown in FIGS. 3 and 6(*a*), the engaged portion 45 is formed on at least one of the front wall 41F and the rear wall 41R of the tab attachment part 4. As shown in FIG. 4, the engaged portion 45 is formed to be engageable with the engaging portion 38 of the tab 3, which has been described. In the present embodiment, the engaged portion 45 opens downward, and is a through hole penetrating through the front wall 41F and the rear wall 41R. When the tab attachment part 4 is attached to the front attachment post 121 and the rear attachment post 122, a rear surface of the base portion 122*a* of the rear attachment post 122 and an upper surface of the upper blade 111 shield the depth part and the lower part of the engaged portion 45, which is penetrated, and the front surface of the base portion 121*a* of the front attachment post 121 and the upper surface of the upper blade 111 shield the depth part and the lower part of the engaged portion 45, which is penetrated. However, the engaged portion 45 may be formed in a recess to be engageable with the engaging portion 38 of the tab 3, instead of being penetrated. In addition, the engaged portion 45 may not necessarily open downward.

Spring Member and Lock Pin

The spring member 5 is provided above the lock pin 6 and biases the pawl portion 62 of the lock pin 6 to enter the element passage 1*a* from the pawl hole 124 provided on the upper blade 111. As shown in FIG. 3, in the present embodiment, in the spring member 5, notches 51 are arranged at both ends of the plate spring, and accordingly, the support pieces 52 are respectively formed at both ends. In the spring member 5, the support pieces 52 at both ends are respectively supported by the support surfaces 121*b* and 122*b* of the front attachment post 121 and the rear attachment post 122, and the notches 51 at both ends are respectively attached to be engaged with the front attachment post 121 and the rear attachment post 122. In the present embodiment, the spring member 5 is attached to the front attachment post 121 and the rear attachment post 122, but may be attached to the inner wall 44 of the tab attachment part 4 to engage the inner wall 44. In addition, at both ends of the spring member 5, instead of the notches 51, hole portions may be formed to be passed through by the upper sides of the front attachment post 121 and the rear attachment post 122.

As shown in FIGS. 3 and 4, the lock pin 6 includes a pushed-up portion 61, the pawl portion 62, and the lock pin base portion 63. The pushed-up portion 61 extends frontward and rearward on the upper side of the shaft portion 33 and is pushed up by the shaft portion 33 of the tab 3, when a user lifts up the tab 3. The pawl portion 62 extends downward from a rear part of the pushed-up portion 61, is formed in a shape with a pointed tip, and is attached to enter the element passage 1*a* through the pawl hole 124 in a state where the tab 3 is tilted. On the other hand, the lock pin base portion 63 extends from a front part of the pushed-up portion 61, extends frontward and downward, and is formed in a hook shape so as to be attached to the recess portion 126 of the slider body 2. The lock pin 6 is capable of swinging in the up and down direction by an upward movement of the shaft portion 33 or a downward biasing force of the spring member 5, with a point where the lock pin base portion 63 contacts the recess portion 126 as the center of swinging. In addition, when a user lifts up the tab 3 to move the shaft portion 33 of the tab 3 upward, the pawl portion 62 retracts from the element passage 1*a* to the upper side of the pawl hole 124, as the pushed-up portion 61 is pushed up. Accordingly, since the pair of element rows (not shown) that pass through the element passage 1*a* are not engaged by the pawl portion 62, the slider 1 becomes slidable. On the other hand, when a user tilts the tab 3, the downward biasing force of the spring member 5 causes the pawl portion 62 of the lock pin 6 to enter the element passage 1*a* so as to engage the pair of element rows (not shown). Accordingly, the slider 1 becomes incapable of sliding.

Then, as shown in FIG. 4, in the slider 1, the shaft portion 33 of the tab 3, the lock pin 6, the spring member 5, and the tab attachment part 4 are attached in this order to the upper surface of the upper blade 111 of the slider body 2. The tab 3 is attached to the slider body 2 so that the shaft portion 33 is mounted on the mounting surface 123 of the tab mounting portion 12. The lock pin 6 is attached such that the lock pin base portion 63 is engaged with the recess portion 126, the pawl portion 62 enters the element passage 1*a* through the pawl hole 12, and the pushed-up portion 61 is located above the shaft portion 33. The spring member 5 is provided above the lock pin 6 so that the support pieces 52 at both ends are respectively supported by the support surfaces 121*b* and 122*b* of the front attachment post 121 and the rear attachment post 122, and the notches 51 at both ends are respectively engaged with the front attachment post 121 and the rear attachment post 122. The tab attachment part 4 is attached on the upper side of the spring member 5 so that the attachment recess portions 44 of the tab attachment part 4 respectively engage the front attachment post 121 and the rear attachment post 122 of the slider body 2. Accordingly, the slider 1 is configured so that the lock pin 6, the spring member 5, and the tab 3 are attached to the slider body 2.

As described above, in the present embodiment, the spring member 5 is a spring with a plate material, which is a so-called plate spring, and functions as a spring utilizing bending deformation of the plate. However, the spring member 5 may be any type of spring member as long as the spring member 5 functions as a spring and is capable of biasing the lock pin 6. For example, a coil spring, a spiral spring, or another elastic material may be used. In addition, the spring member may be a metal spring or a non-metal spring. Further, the spring member 5 may be provided at another part of the lock pin 6. For example, a compression coil spring may be used as the spring member 5, and may be provided on the lower side of the lock pin 6. That is, by selecting an appropriate type of the spring member 5 in combination with the lock pin 6 and configuring the pawl portion 62 of the lock pin 6 to retract from the element passage 1*a* or to enter the element passage 1*a*, the invention is achievable.

In the present embodiment, as shown in FIG. 4, the engaging portion 38 is a projection, and the engaged portion 45 is a recess to be engageable with the engaging portion 38. However, the engaging portion 38 may be a recess, and the engaged portion 45 may be a projection to be engageable with the engaging portion 38. In addition, the engaging portion 38 and the engaged portion 45 may be engaged and secured by a magnet, instead of being a recess or a projection. In other words, the engaged portion 45 may be formed to correspond to the engaging portion 38 so as to be engageable with the engaging portion 38.

Furthermore, in the present embodiment, the engaged portion 45 is formed on both the front wall 41F and the rear wall 41R in the front and rear direction of the tab attachment part 4, but may be formed only on the front wall 41F or the rear wall 41R in the front and rear direction of the tab attachment part 4. In addition, the engaged portion 45 may be provided on the slider body 2. For example, the engaged portion 45 may be formed in a columnar part extending from the upper blade 111 of the slider body 2, or may be formed on the front attachment post 121 and/or the rear attachment post 122.

In the above description, the lock pin 6 and the spring member 5 in the present embodiment are configured to be separate members. However, the lock pin 6 and the spring member may be integrally formed, the tab attachment part 4 and the spring member may be integrally formed, or the tab attachment part 4, the lock pin, and the spring member may be integrally formed. The description will be given in detail below.

As a configuration in which the lock pin 6 and the spring member are integrally formed, the lock pin 6 is manufactured by press molding using a metal material having a high elastic modulus such as stainless steel or a copper alloy. In this case, the lock pin 6 has elasticity, and includes the pawl portion 62 capable of entering the element passage 1*a* through the pawl hole 124 of the slider body 2 at one end, and also includes the lock pin base portion 63 to be fitted and secured into the recess portion 126 provided on the upper blade 111 of the slider body 2 at the other end. When a user lifts up the tab 3 to move the shaft portion 33 of the tab 3 upward, the lock pin 6 is elastically deformed and pushed up, and accordingly, the pawl portion 62 retracts from the element passage 1*a* to the upper side of the pawl hole 124. On the other hand, when a user tilts the tab 3, the restoring force of the lock pin 6 itself biases the lock pin 6 downward, and the pawl portion 62 of the lock pin 6 enters the element passage 1*a* to engage the pair of element rows (not shown).

As a configuration in which the tab attachment part and the spring member are integrally formed, the tab attachment part is manufactured by press molding using a metal material having a high elastic modulus such as stainless steel or a copper alloy. In this case, for example, in the tab attachment part (not shown), a spring member to be secured on the front surface of the front attachment post 121 is provided to extend at a front end of an upper wall facing an upper surface of the slider body 2. When a user lifts up the tab 3 to move the shaft portion 33 of the tab 3 upward, the pushed-up portion 61 of the lock pin 6 is pushed up and additionally contacts the tab attachment part to push up the tab attachment part, and the pawl portion 62 is pulled up from the pawl hole 124 while elastically curving the spring member. The pawl portion 62 is pulled up from the pawl hole 124 to retract from the element passage 1*a* to the upper side of the pawl hole 124. On the other hand, when a user tilts the tab 3, the restoring force of the spring member of the tab attachment part biases the tab attachment part downward, and at the same time, presses down the lock pin 6. Thus, the pawl portion 62 of the lock pin 6 enters the element passage 1*a* to engage the pair of element rows (not shown).

Furthermore, as a configuration in which the tab attachment part, the lock pin, and the spring member are integrally formed, the tab attachment part is manufactured by press molding using a metal material having a high elastic modulus such as stainless steel or a copper alloy. Also in this case, for example, in the tab attachment part (not shown), a spring member to be secured to the front surface of the front attachment post 121 is provided to extend at a front end of the upper wall facing the upper surface of the slider body 2. In addition, the pawl portion and the pushed-up portion are formed by one of the side walls of the tab attachment part. When a user lifts up the tab 3 to move the shaft portion 33 of the tab 3 upward, the pushed-up portion of the tab attachment part is pushed up. Thus, the whole tab attachment part is also pushed up, and the pawl portion is pulled up from the pawl hole 124 while elastically curving the spring member. The pawl portion is pulled up from the pawl hole 124 and retracts from the element passage 1*a* to the upper side of the pawl hole 124. On the other hand, when a user tilts the tab 3, the restoring force of the spring member of the tab attachment part biases the tab attachment part downward. Thus, the pawl portion formed on the side wall of the tab attachment part enters the element passage 1*a* to engage the pair of element rows (not shown).

FIGS. 7(*a*) to 7(*d*) are cross-sectional views showing a situation from a used state where the tab 3 is pulled rearward to an engagement state. The following description will be given of, with reference to FIGS. 7(*a*) to 7(*d*), an operation system from the used state where the tab 3 is pulled rearward to open a fastener stringer (not shown) to the engagement state where the engaging portion 38 of the tab 3 is engaged with the engaged portion 45, while the slider 1 is being used.

FIG. 7(*a*) shows a state where a user pulls the tab 3 to slide the slider body 2 rearward, when the user tries to open the pair of fastener stringers. As shown in FIG. 7(*a*), a tensile force F1 is applied to the tab 3, the shaft portion 33 is moved upward or is raised along the inclined surface 125 provided on the rear side of the mounting surface 123, and accordingly, the pawl portion 62 is pulled up from the pawl hole 124 while the lock pin 6 is elastically curving the spring member 5. The pawl portion 62 is pulled up from the pawl hole 124 and retracts from the element passage 1*a*, thus enabling the slider to slide.

FIG. 7(*b*) shows a tilted state where the tab 3 is tilted rearward, after sliding of the slider 1 is finished and then the tensile force applied to the tab 4 is stopped. As shown in FIG. 7(*b*), after the tensile force applied to the tab 4 is stopped, the restoring force of the spring member 5, which is elastically curved, generates a biasing force for pushing back the lock pin 6 downward. Accordingly, the shaft portion 33 of the tab 3 tends to return to the mounting surface 123 along the inclined surface 125. In the middle of this movement, the engaging portion 38 of the tab 3 contacts the rear wall 41R of the tab attachment part 4, and the tab 3 is tilted rearward. At this time, due to the biasing force of the spring member 5, the pawl portion 62 enters the element passage 1*a* through the pawl hole 124 and holds the slider not to slide.

FIG. 7(*c*) shows a state where the tab 3, which is tilted, is further tilted downward. As shown in FIG. 7(*c*), a downward rotational force F2 is applied to the tab 3, which is tilted, the shaft portion 33 is raised along the inclined surface 125 provided on the rear side of the mounting surface 123, and accordingly, the lock pin 6 elastically curves the spring member 5. At the same time, the engaging portion 38 of the tab 3 moves down along the rear wall 41R of the tab attachment part 4 while contacting the tab attachment part 4. In the present embodiment, since the engaging portion 38 of the tab 3 is formed of a material having an elastic force, for example, a resin, the engaging portion 38 is elastically deformed when the engaging portion 38 is pressed against the tab attachment part 4. However, by modifying the shape of the tab attachment part 4, another configuration may be applicable such that the engaging portion 38 and the tab attachment part 4 do not contact each other, and no elastic deformation of the engaging portion 38 occurs.

FIG. 7(*d*) shows an engagement state where the engaging portion 38 of the tab 3 is engaged with the engaged portion 45 of the tab attachment part 4. As shown in FIGS. 7(*c*) and 7(*d*), when the tab 3, which is tilted, is further tilted downward, the engaging portion 38 of the tab 3 is moved along the rear wall 41R of the tab attachment part 4 to the rear side of the engaged portion 45 of the tab attachment part 4. At this time, the biasing force of the spring member 5 pushes down the pushed-up portion 61 of the lock pin 6, and accordingly, the shaft portion 33 of the tab 3 is pushed down together with the lock pin 6 and returns along the inclined surface 125 to the mounting surface 123, which is provided on the front side of the inclined surface 125. Accordingly, the engaging portion 38 of the tab 3 moves frontward together with the shaft portion 33, and the engaging portion 38 is pulled into the engaged portion 45 of the tab attachment part 4. Since the engaging portion 38 is engaged with the engaged portion 45, the tab 3 can be automatically secured.

FIGS. 8(*a*) to 8(*d*) are cross-sectional views showing a situation from a used state where the tab 3 is pulled frontward to an engagement state. Specifically, FIGS. 8(*a*) to 8(*d*) show an operation system from the used state where the tab 3 is pulled frontward to close a fastener stringer (not shown) to the engagement state where the engaging portion 38 of the tab 3 is engaged with the engaged portion 45. Since the operation system of FIGS. 8(*a*) and 8(*b*) corresponds to FIGS. 7(*a*) and 7(*b*), the description is omitted here. The following description will be given of FIGS. 8(*c*) and 8(*d*).

FIG. 8(*c*) shows a state where the tab 3, which is tilted, is tilted downward. As shown in FIG. 8(*c*), the downward rotational force F2 is applied to the tab 3, which is tilted, the shaft portion 33 is raised along the inclined surface 125 provided on the front side of the mounting surface 123, and accordingly, the lock pin 6 elastically curves the spring member 5. At the same time, the engaging portion 38 of the tab 3 moves down along the front wall 41F of the tab attachment part 4 while contacting the tab attachment part 4.

FIG. 8(*d*) shows the engagement state where the engaging portion 38 of the tab 3 is engaged with the engaged portion 45 of the tab attachment part 4. As shown in FIGS. 8(*c*) and 8(*d*), when the tab 3, which is tilted, is further tilted downward, the engaging portion 38 of the tab 3 moves along the front wall 41F of the tab attachment part 4 to the front side of the engaged portion 45 of the tab attachment part 4. At this time, the biasing force of the spring member 5 pushes down the pushed-up portion 61 of the lock pin 6, and accordingly, the shaft portion 33 of the tab 3 is pushed down together with the lock pin 6 and returns along the inclined surface 125 to the mounting surface 123, which is provided on the rear side of the inclined surface 125. Accordingly, the engaging portion 38 of the tab 3 moves rearward together with the shaft portion 33, the engaging portion 38 is pulled into the engaged portion 45 of the tab attachment part 4. Since the engaging portion 38 is engaged with the engaged portion 45, the tab 3 can be automatically secured.

Variations

In the above-described embodiment, the inclined surface 125 is provided on at least one of the front side and the rear side of the mounting surface 123 of the tab mounting portion 12 in the front and rear direction. Hence, when the tensile force applied to the tab 4 is stopped and the tab 3, which is tilted, is further tilted downward, the biasing force of the spring member 5 pushes down the pushed-up portion 61 of the lock pin 6. Accordingly, the shaft portion 33 of the tab 3 is pushed down together with the lock pin 6 and returns along the inclined surface 125 to the mounting surface 123, which is provided on the front side or the rear side of the inclined surface 125. Accordingly, the engaging portion 38 of the tab 3 moves frontward or rearward together with the shaft portion 33, and the engaging portion 38 is pulled into the engaged portion 45 of the tab attachment part 4. Since the engaging portion 38 is engaged with the engaged portion 45, the tab 3 can be automatically secured.

On the other hand, in the invention, the inclined surface 125 is not always necessarily provided. For example, the engaged portion 45 of the tab attachment part 4 is formed of a material having magnetism, or a magnet is provided in the depth part of the engaged portion 45, and in addition, the engaging portion 38 is formed of a metal. Accordingly, when the tab 3, which is tilted, is further tilted downward from the state shown in the above FIGS. 7(*c*) and 8(*c*), the engaging portion 38 of the tab 3 moves rearward or frontward of the engaged portion 45 of the tab attachment part 4 along the rear wall 41R or the front wall 41F of the tab attachment part 4. At this time, the engaging portion 38 made of a metal is attracted by the magnetism of the engaged portion 45, and the engaging portion 38 is pulled into the engaged portion 45 of the tab attachment part 4. Since the engaging portion 38 is engaged with the engaged portion 45, the tab 3 can be automatically secured.

Effects of the Present Embodiment

A slider 1 for a slide fastener in the present embodiment includes: a slider body 2 including an element passage 1*a* formed by an upper blade 111 and a lower blade 112, the upper blade 111 and the lower blade 112 being connected by a diamond 113; a tab attachment part 4 provided on an upper surface of the upper blade 111; a tab 3 including a knob portion 31, and a connecting portion 32 including a shaft portion 33 mounted on the upper surface of the upper blade 111 and connected with the tab attachment part 4; a lock pin 6 provided above the shaft portion 33 in the upper blade 111, and including a pawl portion 62; and a spring member 5 provided above the lock pin 6 for biasing the pawl portion 62 of the lock pin to enter the element passage 1*a* from a pawl hole 124 provided in the upper blade 111, the slider 1, 100 being characterized in that the tab attachment part 4 is a cover member and has a tunnel shape in a side view to cover the spring member 5 and the lock pin 9 from above, an attachment hole 35 for causing the tab attachment part 4 to pass through is formed in the connecting portion 32 of the tab 3, and an engaging portion 38 projecting toward the shaft portion 33 from an edge portion on the knob portion side of the attachment hole 35 is formed in the tab 3, an engaged portion 45 is formed on at least one of a front wall 41F and a rear wall 41R in a front and rear direction of the tab attachment part 4, and in a case where the tab 3 is tilted to be almost parallel to the upper blade 111 on the engaged portion 45 side of the tab attachment part 4, due to a biasing force of the spring member 5, the lock pin 6 moves the shaft portion 33 of the tab 3 downward and to an opposite side of a tilted direction, and a tip portion 38*b* of the engaging portion 38 of the tab 3 is pulled into the engaged portion 45 side of the tab attachment part 4. Accordingly, regardless of the pivot tab 3, which is pivotable, or the angular tab 3, which is not pivotable, by simply tilting the tab 3, the tip portion of the tab 3 can be pulled into the engaged portion 45 side of the tab attachment part 4 and can be automatically secured. Thus, swinging of the tab 3 can be prevented.

In this manner, according to the invention, it is possible to provide a slider for a slide fastener capable of coping with a slider with an automatic stop function, and capable of securing a tab to enable automatic engagement and preventing swinging of the tab, regardless of the type of the tab, when the tab is tilted to the engaged portion side.

Further, in the slider 1 for the slide fastener in the present embodiment, the upper blade 111 includes a mounting surface 123 on which the shaft portion 33 is mounted, and an inclined surface 125 extending obliquely upward is provided on a front side or/and a rear side in the front and rear direction of the mounting surface 123 to correspond to the engaged portion 45 formed in the tab attachment part 4, and in the case where the tab 3 is tilted to be almost parallel to the upper blade 111 on the engaged portion 45 side of the tab attachment part 4, due to the biasing force of the spring member 5, the shaft portion 33 of the tab 3 moves downward and to the opposite side of the tilted direction along the inclined surface 125. Therefore, by simply devising the tab mounting portion 12, the slider 1 with the automatic securing of the tab can be manufactured easily and at low costs.

Further, in the slider 1 for the slide fastener in the present embodiment, the connecting portion 32 is formed of a metal, and the knob portion 31 and the engaging portion 38 are integrally formed with a resin, and are provided in the connecting portion to cover at least a part of the connecting portion 32. Therefore, the engaging portion 38 can be easily formed together with the knob portion 31, and unnecessary costs and labor can be suppressed. In addition, by manufacturing the tab 3 such that the knob portion 31, which is made of a resin, covers at least a part of the connecting portion 32, which is made of a metal, the tab 3 can further have a sense of stylish.

Further, in the slider 1 for the slide fastener in the present embodiment, the knob portion 31 and the engaging portion 38 are formed in the connecting portion 32 by injection molding. Therefore, the knob portion 31 and the engaging portion 38 of the tab 3 can be formed by a low-cost and simple means, and unnecessary costs and labor can be suppressed.

Further, in the slider 1 for the slide fastener in the present embodiment, the engaging portion 38 has a projecting shape including the tip portion 38*a*, and the engaged portion 45 has a recessed shape for accommodating the tip portion 38*a*. Therefore, since the engaging portion 38 and the engaged portion 45 can be engaged with each other through the projecting shape and the recessed shape, the tab 3 can be engaged stably.

Further, in the slider 1 for the slide fastener in the present embodiment, the tab 3 is attached to the tab attachment part 4 to be freely pivotable in a width direction. Therefore, when the engaging portion 38 of the tab 3 is not engaged with the engaged portion 45 of the tab attachment part 4, the tab 3 is capable of pivoting on a plane almost parallel to the upper surface of the upper blade 111. Accordingly, the flexibility of the tab 3 can be increased, and the convenience of the tab 3 can be improved.

Further, in the slider 1 for the slide fastener in the present embodiment, while the tab 3 is being tilted to be almost parallel to the upper blade, the tab attachment part 4 is formed to contact the engaging portion 38. Therefore, since the engaging portion 38 contacts the tab attachment part 4 by immediately before the tab 3 is engaged, the tab 3 can be stably engaged without swinging. In addition, in the case where the engaging portion 38 is engaged to a state of being pulled into the engaged portion 45 from the state where the engaging portion 38 contacts the tab attachment part 4, the tab 3 can be engaged with the tab attachment part 4 with a click. This further gives the tab 3 a clicking feel and a steady feel, and additionally, the operability of the automatic securing configuration of the tab can be improved.

Further, in the slider 1 for the slide fastener in the present embodiment, the engaging portion 38 includes a projection base portion 38*b*, and a width of the projection base portion is larger than a width of the engaged portion 45 in a width direction. Therefore, when the engaging portion 38 is pulled into the engaged portion 45, the projection base portion 38*b* contacts the front wall 41F or the rear wall 41R near the engaged portion 45, so that an excessive movement of the shaft portion 33 to the depth side is limited. Thus, the tab 3 can be engaged stably without the engaging portion 38 being excessively pulled, and additionally, the tab 3 can be easily rotated also when the tab 3 is operated.

Further, in the slider 1 for the slide fastener in the present embodiment, a hole portion 37 or a recess portion is formed in a part covered with the knob portion 31 in the connecting portion 32. Therefore, since the knob portion 31 is capable of firmly holding the connecting portion 32 through the hole portion 37 or a recess portion of the connecting portion 32, the tab 3 can be formed strongly. In addition, when the tab 3 is pulled, the slider can be slid in a smooth manner without rattling between the knob portion 31 and the connecting portion 32.

Further, in the slider 1 for the slide fastener in the present embodiment, the engaged portion 45 is formed on each the front wall 41F and the rear wall 41R of the tab attachment part 4 in the front and rear direction of the slider. Therefore, even in a case where the tab 3 is rotated frontward or rearward, the engaging portion 38 of the tab 3 can be engaged with the engaged portion 45 of the tab attachment part 4. Accordingly, the convenience of the tab 3 can be improved.

Second Embodiment

Figure 9A:
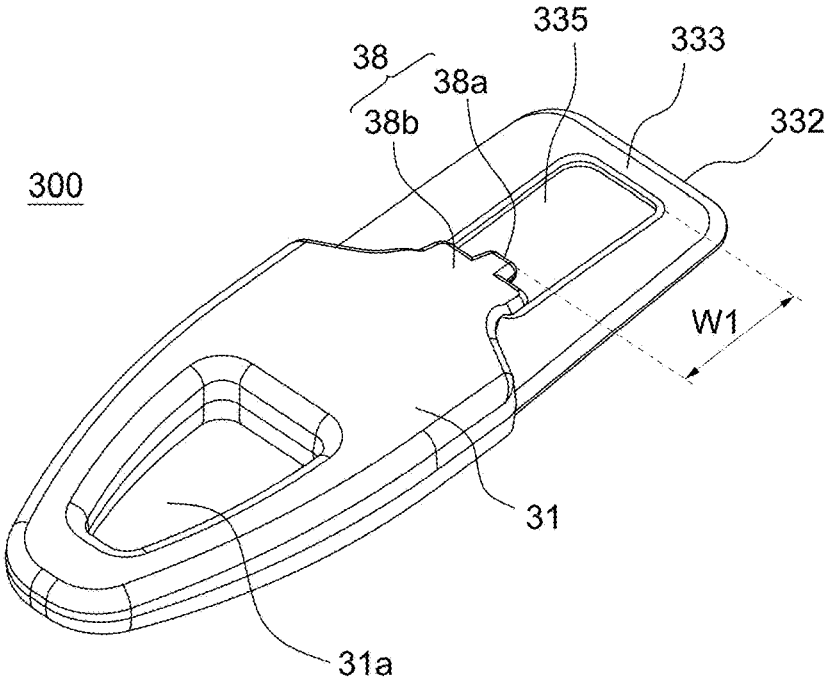
FIG. 9(*a*) is a perspective view of a tab according to another embodiment of the invention.
Figure 9B:
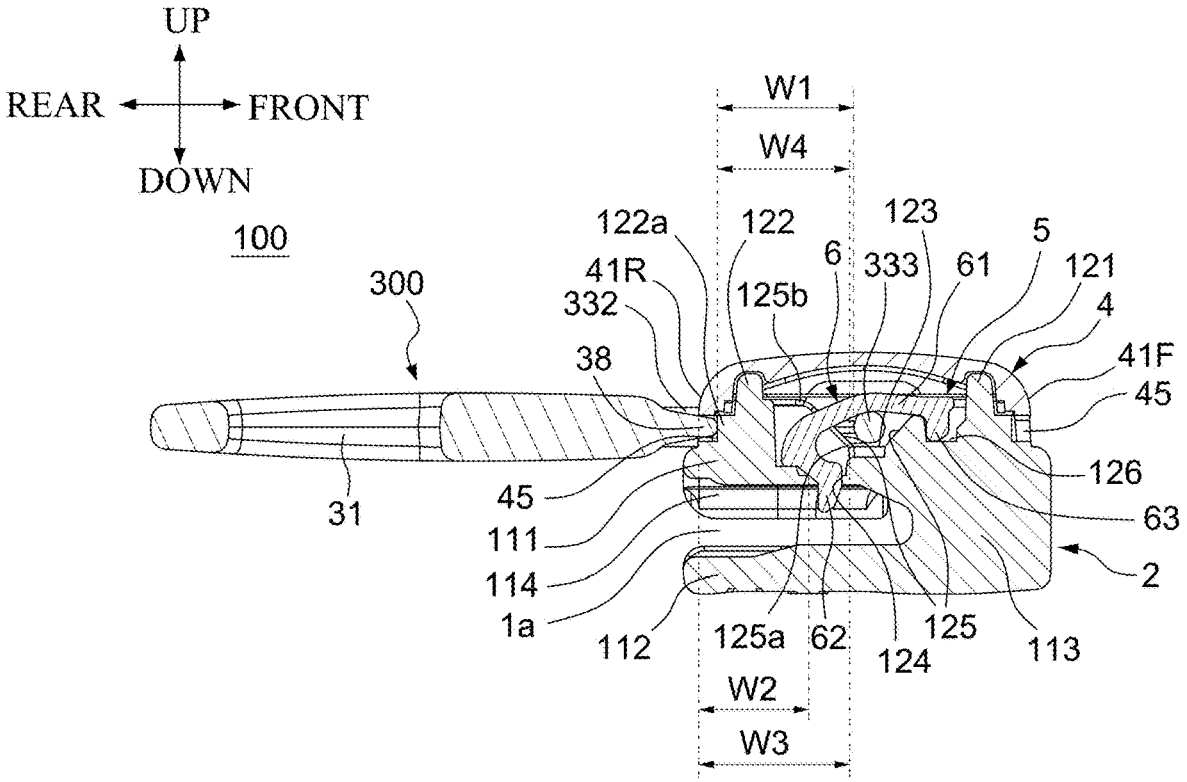

FIG. 9(*a*) is a perspective view of a tab 300 according to another embodiment of the invention, and FIG. 9(*b*) is a cross-sectional view of a slider 100 including the tab 300 of FIG. 9(*a*). In the description of the present embodiment and the reference drawings, a member having a structure similar to that of the member described in the above embodiment is indicated by using an identical code, and the description of the member will be omitted by using such an identical code. In addition, the operation system of the present embodiment corresponds to FIGS. 7(*a*) to 7(*d*) and FIGS. 8(*a*) to 8(*d*).

In the present embodiment, in the tab 300, the shape of a connecting portion 332 including a shaft portion 333 is different from that in the first embodiment. In the connecting portion 332 of the tab 300, as shown in FIG. 9(*a*), the corner part is formed in a substantially rectangular shape with an angle, and an attachment hole 335, through which the tab attachment part 4 is inserted, is not sufficiently large. More specifically, since the width of the attachment hole 335 in the left and right direction is not sufficiently larger than the width of the tab attachment part 4 in the left and right direction, the tab 300 is not pivotable in the width direction of the slide fastener with the tab attachment part 4 as the center. That is, in the present embodiment, the tab 300 is a tab that is not pivotable, which is a so-called angular tab.

As shown in FIG. 9(*b*), according to the invention, even in a case where the tab 300, which is an angular tab, is used, in a similar manner to the operation system that has been described with reference to FIGS. 7(*a*) to 7(*d*) and FIGS. 8(*a*) to 8(*d*), when the tab 300, which is tilted, is further tilted downward, the engaging portion 38 of the tab 300 moves rearward or frontward of the engaged portion 45 of the tab attachment part 4 along the rear wall 41R or the front wall 41F of the tab attachment part 4. At this time, the biasing force of the spring member 5 pushes down the pushed-up portion 61 of the lock pin 6, and accordingly, the shaft portion 33 of the tab 3 is pushed down together with the lock pin 6 and returns along the inclined surface 125 to the mounting surface 123, which is provided on the front side or the rear side of the inclined surface 125. Accordingly, the engaging portion 38 of the tab 3 moves frontward or rearward together with the shaft portion 333, the engaging portion 38 is pulled into the engaged portion 45 of the tab attachment part 4. Since the engaging portion 38 is engaged with the engaged portion 45, the tab 3 can be automatically secured.

Heretofore, the embodiments of the invention have been described with reference to the drawings, specific configurations are not limited to these embodiments. The scope of the invention is indicated by the scope of claims rather than the above description of the embodiments, and further includes all modifications within the meaning and range of equivalency of the claims.

REFERENCE SIGNS LIST

1, 100 slider (slider for slide fastener)
1*a* element passage
2 slider body
3 tab
4 tab attachment part
5 spring member
6 lock pin
12 tab mounting portion
31 knob portion
31*a* knob hole
32 connecting portion
33 shaft portion
33L, 33R both ends
34L, 34R rod portion
35 attachment hole
36 connection base portion
361 edge portion
37 hole portion
38 engaging portion
38*a* tip portion
38*b* projection base portion
40 opening portion
41F front wall
41R rear wall
42 side wall
43 inner wall
44 attachment recess portion
45 engaged portion
51 notch
52 support piece
61 pushed-up portion
62 pawl portion
63 lock pin base portion
111 upper blade
112 lower blade
113 diamond
121 front attachment post
122 rear attachment post
121*a*, 122*a* base portion
121*b*, 122*b* support surface
123 mounting surface
124 pawl hole
125 inclined surface
125*a* lower edge
125*b* upper edge

126 recess portion
300 tab
332 connecting portion
333 shaft portion
335 attachment hole
F1 tensile force
F2 rotational force
W1 dimension
W2 dimension
W3 dimension
W4 dimension

The invention claimed is:

1. A slider for a slide fastener, the slider including:

a slider body including an element passage formed by an upper blade and a lower blade, the upper blade and the lower blade being connected by a diamond;

a tab attachment part provided on an upper surface of the upper blade;

a tab including a knob portion, and a connecting portion including a shaft portion mounted on the upper surface of the upper blade and connected with the tab attachment part;

a lock pin provided above the shaft portion in the upper blade, and including a pawl portion; and a spring member for biasing the pawl portion of the lock pin to enter the element passage from a pawl hole provided in the upper blade, the slider wherein the tab attachment part is a cover member, an attachment hole for causing the tab attachment part to pass through is formed in the connecting portion of the tab, and an engaging portion projecting toward the shaft portion from an edge portion on the knob portion side of the attachment hole is formed in the tab, an engaged portion is formed on the slider body or at least one of a front wall and a rear wall in a front and rear direction of the tab attachment part, and in a case where the tab is tilted to be almost parallel to the upper blade on the engaged portion side of the tab attachment part, due to a biasing force of the spring member, the lock pin moves the shaft portion of the tab downward and to an opposite side of a tilted direction, and a tip portion of the engaging portion of the tab is pulled into to be engaged with the engaged portion side of the tab attachment part.

2. The slider for the slide fastener according to claim 1, wherein the upper blade includes a mounting surface on which the shaft portion is mounted, and an inclined surface extending obliquely upward is provided on a front side and/or a rear side in the front and rear direction of the mounting surface to correspond to the engaged portion formed in the tab attachment part, and in the case where the tab is tilted to be almost parallel to the upper blade on the engaged portion side of the tab attachment part, due to the biasing force of the spring member, the shaft portion of the tab moves downward and to the opposite side of the tilted direction along the inclined surface.

3. The slider according to claim 1, wherein the connecting portion is formed of a metal, and the knob portion and the engaging portion are integrally formed with a resin, and are provided in the connecting portion to cover at least a part of the connecting portion.

4. The slider according to claim 3, wherein the knob portion and the engaging portion are formed in the connecting portion by injection molding.

5. The slider according to claim 3, wherein a hole portion or a recess portion is formed in a part covered with the knob portion in the connecting portion.

6. The slider according to claim 1, wherein the tab is attached to the slider body to be freely pivotable in a width direction.

7. The slider according to claim 1, wherein the engaging portion has a projecting shape including the tip portion, and the engaged portion has a recessed shape for accommodating the tip portion.

8. The slider according to claim 7, wherein while the tab is being tilted to be almost parallel to the upper blade, the tab attachment part is formed to contact the engaging portion.

9. The slider according to claim 7, wherein the engaging portion includes a projection base portion, and a width of the projection base portion is larger than a width of the engaged portion in a width direction.

10. The slider according to claim 1, wherein the slider body includes a front attachment post and a rear attachment post for attaching the tab attachment part, and the engaged portion is formed on each the front attachment post and the rear attachment post of the slider body or each the front wall and the rear wall of the tab attachment part in the front and rear direction of the slider.

* * * * *